US009134048B2

(12) United States Patent
Matsubara

(10) Patent No.: US 9,134,048 B2
(45) Date of Patent: Sep. 15, 2015

(54) REGENERATIVE REFRIGERATOR AND PARTITIONING MEMBER

(75) Inventor: Takahiro Matsubara, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 13/429,530

(22) Filed: Mar. 26, 2012

(65) Prior Publication Data

US 2012/0247143 A1 Oct. 4, 2012

(30) Foreign Application Priority Data

Apr. 4, 2011 (JP) ..... 2011-083192

(51) Int. Cl.

| | |
|---|---|
| ***F25B 9/00*** | (2006.01) |
| ***F28D 20/00*** | (2006.01) |
| ***F25B 15/06*** | (2006.01) |
| ***F25B 9/14*** | (2006.01) |

(52) U.S. Cl.

CPC ..... *F25B 9/14* (2013.01); *F25B 2309/003* (2013.01)

(58) Field of Classification Search

CPC ..... F25B 15/00; F25B 15/06; B23P 15/06; B23P 15/08; F28D 17/005; F28D 20/00; Y10S 165/021; B65H 3/24; H01L 39/04

USPC ..... 62/476, 6, 482, 489, 518, 494; 165/4, 9

See application file for complete search history.

(56) References Cited

U.S. PATENT DOCUMENTS

| | | | | | |
|---|---|---|---|---|---|
| 5,447,034 | A | * | 9/1995 | Kuriyama et al. | 62/51.1 |
| 5,469,709 | A | * | 11/1995 | Lee | 62/6 |
| 5,590,533 | A | * | 1/1997 | Asami et al. | 62/6 |
| 2010/0164518 | A1 | * | 7/2010 | Yamada et al. | 324/754 |

FOREIGN PATENT DOCUMENTS

| | | | | |
|---|---|---|---|---|
| JP | 03-208378 | | | 9/1991 |
| JP | 03208378 | | * | 9/1991 |
| JP | 03208378 | A | * | 9/1991 |
| JP | H09-014799 | | | 1/1997 |
| JP | 09-178278 | | | 7/1997 |
| JP | 09210483 | A | * | 8/1997 |
| JP | 2002318021 | | * | 2/2002 |
| JP | 2002318021 | A | * | 10/2002 |
| JP | 2002-318021 | | * | 3/2003 |
| JP | 2004-293924 | | | 10/2004 |

(Continued)

*Primary Examiner* — Frantz Jules
*Assistant Examiner* — Martha Tadesse
(74) *Attorney, Agent, or Firm* — IPUSA, PLLC

(57) ABSTRACT

A regenerative refrigerator includes a cylinder, a regenerator containing a regenerator material, and a partitioning member provided in the regenerator and partitioning off the regenerator material. The partitioning member includes a ring member having a center opening and having an outer circumferential surface fitting with the inner circumferential surface of the regenerator, and a layered body provided on the ring member to close its center opening. The layered body includes a filter member and a reinforcing member stacked in multiple layers. The filter member is configured to prevent passage of the regenerator material and to allow passage of a refrigerant gas. The reinforcing member is configured to reinforce the filter member. The layered body has a peripheral edge portion held tight from the first and second opposite sides of the layered body in its stacking direction by the ring member.

12 Claims, 8 Drawing Sheets

(56) References Cited

FOREIGN PATENT DOCUMENTS

| | | | | |
|---|---|---|---|---|
| JP | 2004293924 | A | * | 10/2004 |
| JP | 2008096040 | | * | 4/2008 |
| JP | 2008096040 | A | * | 4/2008 |
| JP | 2011-027272 | | | 2/2011 |
| JP | 2011027272 | A | * | 2/2011 |

* cited by examiner

REGENERATIVE REFRIGERATOR AND PARTITIONING MEMBER

CROSS-REFERENCE TO RELATED APPLICATION

The present application is based upon and claims the benefit of priority of Japanese Patent Application No. 2011-083192, filed on Apr. 4, 2011, the entire contents of which are incorporated herein by reference.

BACKGROUND OF THE INVENTION

1. Field of the Invention

The present invention relates to a regenerative refrigerator that uses a refrigerant gas such as helium gas and includes a regenerator containing a regenerator material, and to a partitioning member that partitions off the regenerator material provided in the regenerative refrigerator.

2. Description of the Related Art

A regenerative refrigerator that uses a refrigerant gas such as helium gas and has a regenerator containing a regenerator material is used to attain a cryogenic temperature of approximately 4 K, for example. Further, for example, a Gifford-McMahon (GM) refrigerator is used as the regenerative refrigerator.

The GM refrigerator generates cold heat by supplying an expansion space formed in a cylinder with a refrigerant gas composed of, for example, helium gas from a compressor and causing the fed refrigerant gas to expand in the expansion space. Usually, the GM refrigerator has multiple stages in order to attain cryogenic temperatures with the generated cold heat.

Each of the stages of the GM refrigerator includes a cylinder and a displacer provided in the cylinder. The displacer is so provided inside the cylinder as to be reciprocatable along the cylinder. An expansion space is formed between one end of the displacer and the cylinder. Further, a refrigerant gas passage for feeding a refrigerant gas into and discharging the refrigerant gas from the expansion space is defined inside the displacer. Further, a regenerator material that comes into contact with the refrigerant gas to store cold heat is contained inside the displacer.

Inside such a displacer, a partitioning member that partitions off a regenerator material or separates regenerator materials is provided in order to fill a predetermined space with a regenerator material or to prevent mixture of regenerator materials in the case of using multiple kinds of regenerator materials. (See, for example, Japanese Laid-Open Patent Application No. 2004-293924.)

SUMMARY OF THE INVENTION

According to an aspect of the present invention, a regenerative refrigerator includes a cylinder configured to cause a refrigerant gas to expand; a regenerator containing a regenerator material and configured to accumulate, in the regenerator material, cold heat generated in the cylinder with expansion of the refrigerant gas; and a partitioning member provided in the regenerator and partitioning off the regenerator material, the partitioning member including a ring member having a center opening, the ring member having an outer circumferential surface fitting with an inner circumferential surface of the regenerator; and a layered body provided on the ring member to close the center opening thereof, the layered body including a filter member and a reinforcing member stacked in multiple layers, the filter member being configured to prevent passage of the regenerator material and to allow passage of the refrigerant gas, the reinforcing member being configured to reinforce the filter member, the layered body having a peripheral edge portion thereof held tight from first and second opposite sides of the layered body in a stacking direction thereof by the ring member.

According to an aspect of the present invention, a partitioning member configured to partition off a regenerator material contained in a regenerator of a regenerative refrigerator includes a ring member having a center opening, the ring member having an outer circumferential surface so formed as to fit with an inner circumferential surface of the regenerator; and a layered body provided on the ring member to close the center opening thereof, the layered body including a filter member and a reinforcing member stacked in multiple layers, the filter member being configured to prevent passage of the regenerator material and to allow passage of a refrigerant gas, the reinforcing member being configured to reinforce the filter member, the layered body having a peripheral edge portion thereof held tight from first and second opposite sides of the layered body in a stacking direction thereof by the ring member.

The object and advantages of the embodiment will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENT

As described above, a partitioning member is provided inside a displacer of the GM refrigerator. However, this partitioning member has the following problems.

If the outer circumferential (peripheral) surface of the partitioning member does not have good dimensional accuracy, a gap may be formed between the outer circumferential surface of the partitioning member and the inner circumferential surface of the displacer, so that movement of a regenerator material or mixture of regenerator materials may be caused through the formed gap. Accordingly, it is desirable to form the peripheral shape of the partitioning member with good dimensional accuracy in order to prevent formation of a gap between the outer circumferential surface of the partitioning member and the inner circumferential surface of the displacer.

However, as described in Japanese Laid-Open Patent Application No. 2004-293924, the conventional partitioning member is formed by fixing two circular metal plates by welding with a wire mesh held between the two circular metal plates. Therefore, there may be a problem in that the partitioning member cannot have a peripheral shape with good dimensional accuracy without improving the dimensional accuracy of the periphery of each of the two circular metal plates and the wire mesh. Further, the conventional partitioning member includes two circular metal plates, and has a large number of components other than a wire mesh having a filter function. In addition, it is necessary to fix the two circular metal plates to each other with their centers being aligned with extremely high accuracy. Therefore, there may be the problem of an increase in manufacturing cost.

Further, the above-described problems are not limited to partitioning members provided inside displacers of GM refrigerators, and are also shared by partitioning members provided inside regenerators or regenerator tubes of various kinds of regenerative refrigerators, such as regenerator tubes of pulse tube refrigerators.

According to an aspect of the present invention, a partitioning member for partitioning off a regenerator material accommodated in a regenerator of a regenerative refrigerator is provided that has such high dimensional accuracy as to prevent formation of a gap between its outer circumferential surface and the inner circumferential surface of the regenerator; and allows manufacturing cost to be reduced. Further, a regenerative refrigerator is provided that includes the partitioning member.

A description is given below, with reference to the accompanying drawings, of an embodiment of the present invention.

Figure 1:
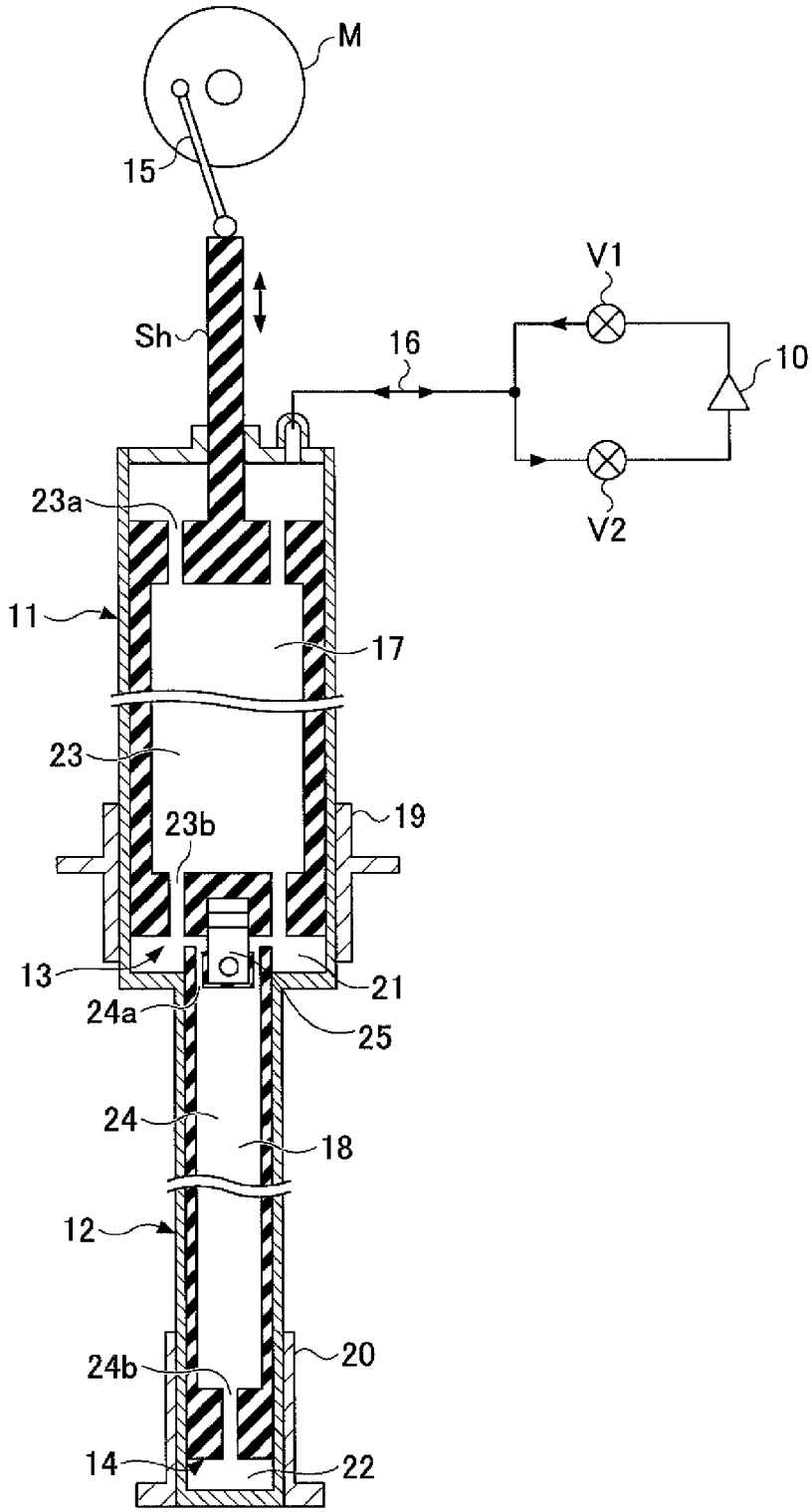
FIG. 1 is a schematic cross-sectional view of a GM refrigerator according to an embodiment, illustrating a configuration of the GM refrigerator.

A description is given, with reference to FIG. 1, of a GM refrigerator according to this embodiment. This GM refrigerator, which is an application of a regenerative refrigerator including a partitioning member according to an embodiment of the present invention to a GM refrigerator, has a two-stage configuration suitable for attaining cryogenic temperatures of approximately a few K to approximately 20 K.

FIG. 1 is a schematic cross-sectional view of the GM refrigerator according to this embodiment, illustrating a configuration of the GM refrigerator.

The GM refrigerator includes a compressor 10, a first-stage cylinder 11, a second-stage cylinder 12, a first-stage displacer 13, a second-stage displacer 14, a crank mechanism 15, a refrigerant gas passage 16, regenerator materials 17 and 18, stages 19 and 20, expansion spaces 21 and 22, and hollow (internal) spaces (refrigerant gas passages) 23 and 24.

In the arrangement illustrated in FIG. 1, the upper end and the lower end of each of the first-stage cylinder 11, the second-stage cylinder 12, the first-stage displacer 13, and the second-stage displacer 14 are a high-temperature end and a low-temperature end, respectively. (The same applies to FIG. 2.)

The compressor 10 generates high-pressure helium gas by compressing helium gas (refrigerant gas) to approximately 20 $Kgf/cm^2$. The generated high-pressure helium gas is supplied into the first-stage cylinder 11 through an intake valve V1 and the refrigerant gas passage 16. Further, low-pressure helium gas discharged from the first-stage cylinder 11 is collected into the compressor 10 via the refrigerant gas passage 16 and an exhaust valve V2.

The second-stage cylinder 12 is joined to the first-stage cylinder 11. The first-stage displacer 13 and the second-stage displacer 14, which are joined to each other, are accommodated in the first-stage cylinder 11 and the second-stage cylinder 12, respectively.

A drive shaft Sh extends upward from the first-stage cylinder 11 to be joined to the crank mechanism 15, which is joined to a drive motor M.

The first-stage displacer 13 is so provided inside the first-stage cylinder 11 as to be reciprocatable along the first-stage cylinder 11. The first-stage displacer 13 defines the expansion space 21 at one end of the first-stage cylinder 11. The first-stage displacer 13 has, for example, a cylindrical shape.

Further, the hollow space (refrigerant gas passage) 23 for supplying the refrigerant gas to and discharging the refrigerant gas from the expansion space 21 is formed inside the first-stage displacer 13. Cold heat (cold) is generated (or heat is removed) with the expansion of the refrigerant gas in the expansion space 21 as the first-stage displacer 13 reciprocates along the first-stage cylinder 11.

The first-stage displacer 13 may correspond to a regenerator according to an aspect of the present invention.

The regenerator material 17 is contained inside the hollow space 23. The regenerator material 17 accumulates cold heat by coming into contact with the discharged refrigerant gas when the refrigerant gas is discharged from the expansion space 21. That is, the regenerator material 17 stores cold heat generated with the expansion of the refrigerant gas in the expansion space 21.

The second-stage displacer 14 is so provided inside the second-stage cylinder 12 as to be reciprocatable along the second-stage cylinder 12. The second-stage displacer 14 defines the expansion space 22 at one end of the second-stage cylinder 12. The second-stage displacer 14 has, for example, a cylindrical shape.

Further, the hollow space (refrigerant gas passage) 24 for supplying the refrigerant gas to and discharging the refrigerant gas from the expansion space 22 is formed inside the second-stage displacer 14. Cold heat is generated with the expansion of the refrigerant gas in the expansion space 22 when the second-stage displacer 14 reciprocates along the second-stage cylinder 12.

The second-stage displacer 14 may correspond to a regenerator according to an aspect of the present invention.

The regenerator material 18 is contained inside the hollow space 24. The regenerator material 18 accumulates cold heat by coming into contact with the discharged refrigerant gas when the refrigerant gas is discharged from the expansion space 22. That is, the regenerator material 18 stores cold heat generated with the expansion of the refrigerant gas in the expansion space 22.

The first-stage stage 19 is thermally coupled to the first-stage cylinder 11 so as to surround the lower end (low-temperature end) of the first-stage cylinder 11. The second-stage stage 20 is thermally coupled to the second-stage cylinder 12 so as to surround the lower end (low-temperature end) of the second-stage cylinder 12.

The first-stage cylinder 11 and the second-stage cylinder 12 are preferably made of, for example, stainless steel (such as SUS304 of Japanese Industrial Standards) or the like. This allows the first-stage cylinder 11 and the second-stage cylinder 12 to have high strength, low thermal conductivity, and high helium gas shielding capability.

The first-stage displacer 13 and the second-stage displacer 14 are preferably made of, for example, fabric-containing phenolic resin (Bakelite) or the like. This allows the first-stage displacer 13 and the second-stage displacer 14 to be reduced in weight, to be better in wear resistance and strength, and to reduce the amount of heat entering the low-temperature side from the high-temperature side.

The first-stage regenerator material 17 is preferably formed of, for example, a wire mesh or the like, and the second-stage regenerator material 18 is preferably formed of, for example, lead balls or a magnetic regenerator material. This makes it possible to ensure sufficiently high heat capacity in a low temperature range.

The GM refrigerator thus configured generates cold heat as follows.

High-pressure refrigerant helium gas supplied from the compressor 10 via the intake valve V1 is supplied into the first-stage cylinder 11 via the refrigerant gas passage 16. The high-pressure helium gas passes through an opening (refrigerant gas passage) 23*a*, the hollow space (refrigerant gas passage) 23 containing the regenerator material 17, and an opening (refrigerant gas passage) 23*b* to be supplied to the first-stage expansion space 21.

The high-pressure helium gas supplied to the first-stage expansion space 21 further passes through an opening (refrigerant gas passage) 24*a*, the hollow space (refrigerant gas passage) 24 containing the regenerator material 18, and an opening (refrigerant gas passage) 24*b* to be supplied to the second-stage expansion space 22.

Figure 2:
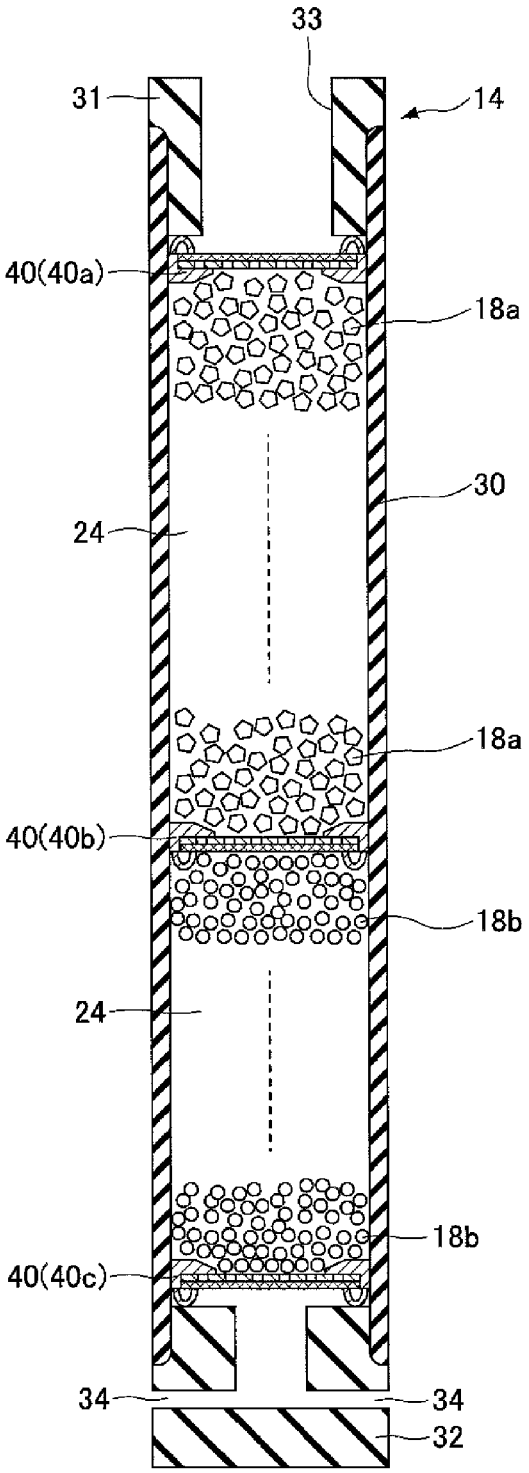
FIG. 2 is a schematic cross-sectional view of a second-stage displacer in the GM refrigerator according to the embodiment, illustrating a configuration of the second-stage displacer.

The refrigerant gas passages 23*a*, 23*b*, 24*a*, and 24*b* are functionally described in order to illustrate a flow of the refrigerant gas, and are different from their actual structures illustrated using FIG. 2.

When the intake valve V1 is closed and the exhaust valve V2 is opened, the high-pressure helium gas in the second-stage cylinder 12 and the first-stage cylinder 11 follows the intake path in the reverse direction to be collected into the compressor 10 through the refrigerant gas passage 16 and the exhaust valve V2.

When the GM refrigerator is in operation, the rotational driving force of the drive motor M is converted into the reciprocating driving force of the drive shaft Sh by the crank mechanism 15. The drive shaft Sh causes the first-stage displacer 13 and the second-stage displacer 14 to vertically reciprocate (along the first-stage cylinder 11 and the second-stage cylinder 12, respectively) as indicated by a double-headed arrow in FIG. 1.

When the first-stage displacer 13 and the second-stage displacer 14 are driven in a direction away from the drive shaft Sh (downward in FIG. 1) by the drive shaft Sh, the intake valve V1 is opened and the exhaust valve V2 is closed to allow high-pressure helium gas to be supplied into the expansion space 21 inside the first-stage cylinder 11 and the expansion space 22 inside the second-stage cylinder 12 (a supply process).

Further, when the first-stage displacer 13 and the second-stage displacer 14 are driven in a direction toward the drive shaft Sh (upward in FIG. 1) by the drive shaft Sh, the intake valve V1 is closed and the exhaust valve V2 is opened. The pressure of the expansion space 21 inside the first-stage cylinder 11 and the pressure of the expansion space 22 inside the second-stage cylinder 12 are reduced, and the helium gas is discharged from the expansion space 21 and the expansion space 22 to be collected into the compressor 10 (a discharge process).

At this point, the helium gas expands to generate cold heat in the expansion spaces 21 and 22. The helium gas, having generated cold heat and been cooled, cools the regenerator materials 17 and 18 by coming into contact and exchanging heat with the regenerator materials 17 and 18 when being discharged from the expansion spaces 21 and 22. That is, the generated cold heat is accumulated in the regenerator materials 17 and 18.

High-pressure helium gas supplied in the subsequent supply process is cooled by being supplied through the regenerator materials 17 and 18. The cooled helium gas is further cooled through its expansion in the expansion spaces 21 and 22.

By repeating the supply process and the discharge process as described above, the expansion space 21 inside the first-stage cylinder 11 is cooled to temperatures of, for example, approximately 40 K to approximately 70 K, and the expansion space 22 of the second-stage cylinder 12 is cooled to temperatures of, for example, approximately a few K to approximately 20 K.

Next, a description is given in more detail, with reference to FIG. 2, of a configuration of the second-stage displacer 14. FIG. 2 is a schematic cross-sectional view of the second-stage displacer 14 in the GM refrigerator according to this embodiment, illustrating a configuration of the second-stage displacer 14.

The second-stage displacer 14 includes a tube member 30 and lid members 31 and 32. A hollow space 24, which is a refrigerant gas passage in which a refrigerant gas flows, is defined inside the tube member 30.

The lid member 31 is inserted into and adhered to the tube member 30 at its upper end (high-temperature end). The lid member 31 has an opening 33 (the opening 24*a* illustrated in FIG. 1) provided at its upper end (high-temperature end). The hollow space (refrigerant gas passage) 24 has its high-temperature end communicating with the opening 33. The lid member 31 is joined to the first-stage displacer 13 via a joining mechanism 25 (FIG. 1).

The lid member 32 is inserted into and adhered to the tube member 30 at its lower end (low-temperature end). The lid member 32 has an opening 34, which defines the refrigerant gas passage 24*b* (FIG. 1), provided on its outer circumferential (peripheral) surface. The hollow space (refrigerant gas passage) 24 has its low-temperature end communicating with the opening 34.

As described above, the tube member 30 and the lid members 31 and 32 are preferably made of, for example, fabric-containing phenolic resin (Bakelite) or the like.

As illustrated in FIG. 2, the hollow space (refrigerant gas passage) 24 is filled with multiple kinds (two kinds in FIG. 2) of regenerator materials 18*a* and 18*b*, which correspond to the above-described regenerator material 18. A refrigerant gas flows through the hollow space (refrigerant gas passage) 24 to exchange heat with the regenerator materials 18*a* and 18*b*, so that the regenerator materials 18*a* and 18*b* store cold heat. As described above, lead balls or bismuth balls may be used as the regenerator material 18*a*, and a magnetic regenerator material may be used as the regenerator material 18*b*. The magnetic regenerator material has higher specific heat than lead at temperatures lower than or equal to 15 K. Therefore, by using lead balls for the regenerator material 18*a* on the high-temperature side and using a magnetic regenerator material for the regenerator material 18*b* on the low-temperature side as the regenerator material 18, it is possible to optimize the heat capacity of the regenerator material 18 from its high-temperature end to its low-temperature end.

The second-stage displacer 14 includes partitioning members 40*a*, 40*b*, and 40*c* provided in the hollow space (refrigerant gas passage) 24. The partitioning members 40*a*, 40*b*, and 40*c* separate the regenerator materials 18*a* and 18*b* from each other in order to fill the hollow space 24 with the regenerator materials 18*a* and 18*b* and to prevent the regenerator materials 18*a* and 18*b* from mixing with each other. The partitioning member 40*a* is provided between the lid member 31 and the regenerator material 18*a*. The partitioning member 40*b* is provided between the regenerator material 18*a* and the regenerator material 18*b*. The partitioning member 40*c* is provided between the regenerator material 18*b* and the lid member 32. Hereinafter, the partitioning members 40*a*, 40*b*, and 40*c* may also be collectively referred to as a "partitioning member 40" when illustrating a configuration common to the partitioning members 40*a*, 40*b*, and 40*c*.

Next, a description is given, with reference to FIG. 3 through FIG. 6, of a configuration of the partitioning member 40.

Figure 3:
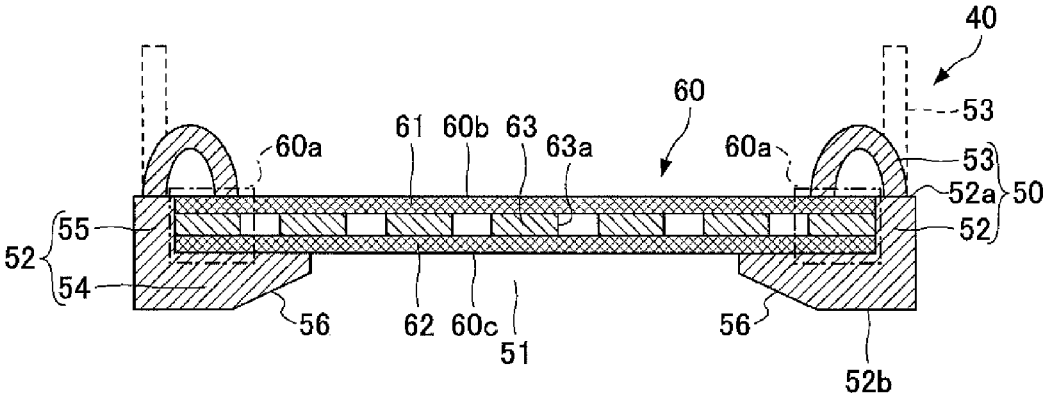
FIG. 3 is a schematic cross-sectional view of a partitioning member according to the embodiment, illustrating a configuration of the partitioning member.
Figure 4:
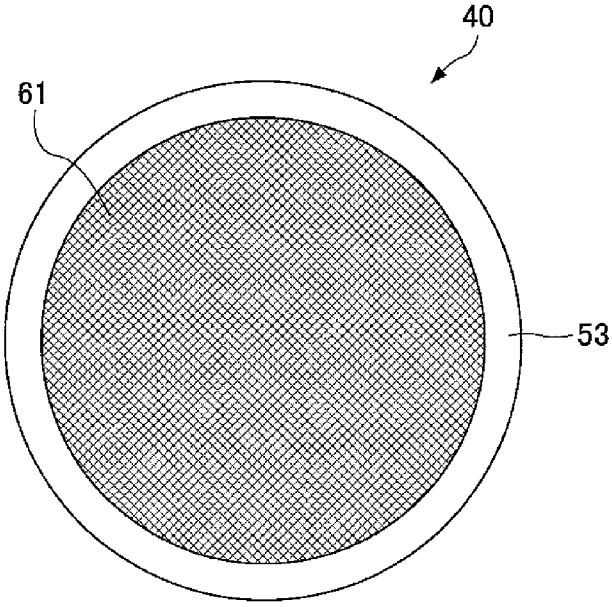
FIG. 4 is a plan view of the partitioning member according to the embodiment, illustrating a configuration of the partitioning member.
Figure 5:
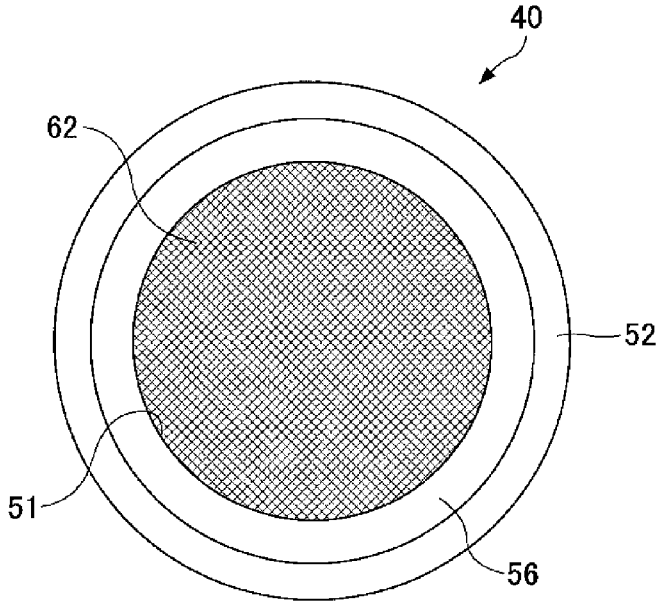
FIG. 5 is a bottom view of the partitioning member according to the embodiment, illustrating a configuration of the partitioning member.
Figure 6:
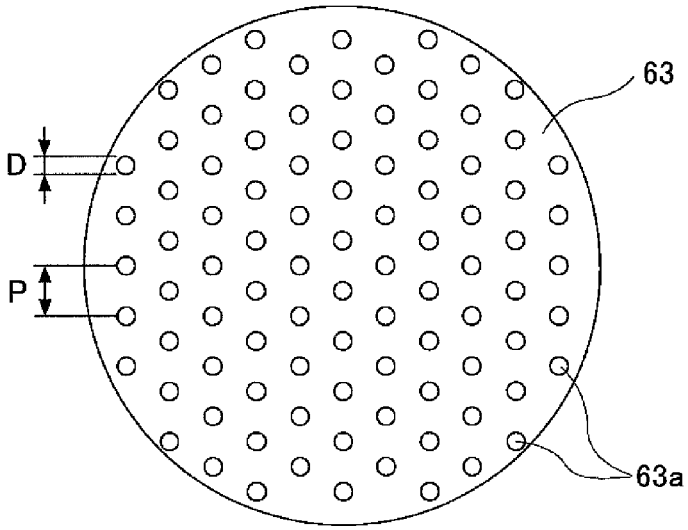
FIG. 6 is a plan view of a reinforcing member according to the embodiment, illustrating a configuration of the reinforcing member.

FIG. 3 is a schematic cross-sectional view of the partitioning member 40, illustrating a configuration of the partitioning member 40 according to this embodiment. FIG. 4 and FIG. 5 are a plan view and a bottom view of the partitioning member 40, illustrating a configuration of the partitioning member 40. FIG. 6 is a plan view of a reinforcing member 63, illustrating a configuration of the reinforcing member 63.

In the plan view of FIG. 4 and in the bottom view of FIG. 5, filter members 61 and 62 are illustrated with hatching.

The partitioning member 40 includes a ring member 50 and a layered body 60.

The ring member 50 has an opening 51 formed in its center. The ring member 50 is so formed that its outer circumferential (peripheral) surface fits with the inner circumferential surface of the tube member 30 of the second-stage displacer 14. The ring member 50 is made of, for example, brass.

The layered body 60 is composed of the filter members 61 and 62 and the reinforcing member 63, which are stacked along the axial directions of the second-stage displacer 14. The layered body 60 is so provided on the ring member 50 as to close its opening 51. A peripheral edge portion 60*a* of the layered body 60 is held tight from a first (front) side and a second (rear) side in a stacking (layering) direction of the layered body 60, that is, from the upper side and the lower side in FIG. 3, by the ring member 50. In other words, the layered body 60 has a first surface 60*b* (upper surface) and a second surface 60*c* (lower surface) facing away from each other along the stacking direction of the layered body 60, and has the peripheral edge portion 60*a* held tight from the first surface 60*b* and the second surface 60*c* by the ring member 50.

The filter members 61 and 62 are so provided as to prevent passage of a regenerator material and to allow passage of a refrigerant gas. Various members may be used for the filter members 61 and 62, including fibrous materials such as felt and porous bodies such as sintered metal. Preferably, for example, a single wire mesh or multiple layers of wire meshes are used for the individual filter members 61 and 62. Use of a wire mesh makes it possible to reduce the thickness of the layered body 60 and also to increase the dimensional accuracy of the openings (such as pores) of the filter members 61 and 62. Accordingly, it is possible to reduce pressure loss that is generated when the refrigerant gas passes through the partitioning member 40, and also to reduce in-plane variations in pressure loss in a cross section perpendicular to the axial directions of the second-stage displacer 14. If the particle size of the regenerator material is, for example, 150 μm to 500 μm, a wire mesh of SUS304 of 300 mesh size (approximately 80 μm in opening width) may be used.

Referring to FIG. 6, holes 63*a* are formed in the reinforcing member 63 to allow passage of a refrigerant gas. The reinforcing member 63 reinforces the filter members 61 and 62. Punching metal may be used as the reinforcing member 63. For example, a 60° staggered type of punching metal made of SUS304, having a hole 63*a* diameter D of 1.0 mm, having a hole 63*a* pitch P of 1.5 mm, and having a thickness of 0.5 mm may be used.

If a gap is formed between the outer circumferential (peripheral) surface of the partitioning member 40 and the inner circumferential surface of the tube member 30, the regenerator material moves through the formed gap. Therefore, it is preferable that no gap be formed between the outer circumferential surface of the partitioning member 40 and the inner circumferential surface of the tube member 30. On the other hand, the partitioning member 40 according to this embodiment is so formed that not the peripheral edge portion 60*a* of the layered body 60 including the filter members 61 and 62 that allows passage of a refrigerant gas, but the outer circumferential (peripheral) surface of the ring member 50 fits with the inner circumferential surface of the tube member 30. This allows the dimensional accuracy of the outer circumferential surface of the whole partitioning member 40 to be controlled with the dimensional accuracy of the outer circumferential surface of the ring member 50. Accordingly, it is possible to manufacture the partitioning member 40 with a good dimensional accuracy of its outer circumferential surface.

The ring member 50 may include a body part 52 and a claw part 53. The body part 52 has the opening 51 formed in its center. The body part 52 includes a first surface 52*a* (upper surface) and a second surface 52*b* (lower surface). The claw part 53 is provided on the body part 52 on its one side in the axial directions of the second-stage displaces 14 (that is, on the first surface 52*a* of the body part 52 in its periphery in FIG. 3). The claw part 53 may be formed as a unit with the body part 52. The layered body 60 may have its peripheral edge portion 60*a* held tight from the front side and the rear side in a stacking (layering) direction of the layered body 60, that is, from the upper side and the lower side in FIG. 3, by the claw part 53 and the body part 52. In other words, the peripheral edge portion 60*a* of the layered body 60 may be fixed by being caulked by the claw part 53.

The body part 52 and the claw part 53 may be so formed as to surround the peripheral edge portion 60*a* of the layered body 60 from its outside. For example, as indicated by broken lines in FIG. 3, the claw part 53 may be formed on the periphery of the body part 52 (along its circumference) to extend upward from the body part 52. Then, for example, by bending the claw part 53 toward inside the ring member 50 to its center using a jig (not graphically illustrated) with the layered body 60 being mounted on the body part 52, it is possible to hold tight the peripheral edge portion 60*a* of the layered body 60 with (between) the deformed claw part 53 and the body part 52. Alternatively, by crushing the claw part 53 by applying a compressive stress to the ring member 50 from its upper side and lower side, it is also possible to hold tight the peripheral edge portion 60*a* of the layered body 60 with (between) the deformed claw part 53 and the body part 52.

In the case illustrated in FIG. 3, the body part 52 includes a placement part 54 for placing the layered body 60 and a surrounding part 55 that surrounds the peripheral edge portion 60*a* of the layered body 60 placed on the placement part 54. This allows the ring member 50 to hold the layered body 60 without the peripheral edge portion 60*a* of the layered body 60 being exposed on the outer circumferential surface of the partitioning member 40.

Further, the layered body 60 may have such a layered structure that the filter member 61 is positioned at (or defines) the outermost layer on the claw part 53 side and the filter member 62 is positioned at (or defines) the outermost layer on the body part 52 side. That is, the layered body 60 may have the three layers of the filter member 61, the reinforcing member 63, and the filter member 62 stacked in this order from the claw part 53 side to the body part 52 side, that is, from the upper side to the lower side, of the layered body 60. This makes it possible to prevent formation of irregularities due to the holes 63*a* formed in the reinforcing member 63 on the surface of the layered body 60 on its claw part 53 side (on the upper surface of the layered body 60 in FIG. 3). Further, it is also possible to prevent formation of a gap between the claw part 53 and the upper surface of the layered body 60 at the time of holding the peripheral edge portion 60*a* of the layered body 60 with the deformed claw part 53, thus preventing a regenerator material from moving beyond the partitioning member 40 through such a gap.

Figure 7:
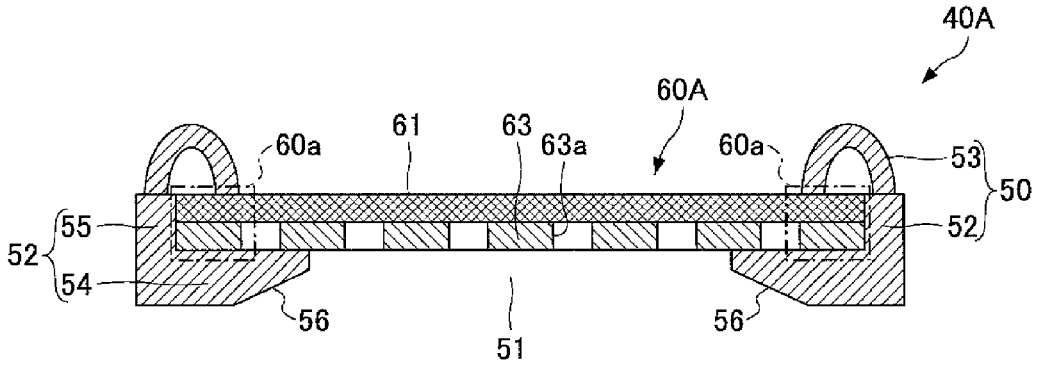
FIG. 7 is a schematic cross-sectional view of the partitioning member according to the embodiment, illustrating another configuration of the partitioning member.

The layered body 60 may also have such a layered structure that the filter member 61 is positioned at (or defines) the outermost layer on the claw part 53 side. That is, the layered body 60 may have the two layers of the filter member 61 and the reinforcing member 63 stacked in this order from the claw part 53 side to the body part 52 side, that is, from the upper side to the lower side, of the layered body 60. FIG. 7 is a schematic cross-sectional view of a partitioning member 40A including a layered body 60A having such a structure, illustrating a configuration of the partitioning member 40A. In the case illustrated in FIG. 7 as well, it is possible to prevent formation of a gap between the claw part 53 and the upper surface of the layered body 60A, thus preventing a regenerator material from moving beyond the partitioning member 40A through such a gap.

Figure 8:
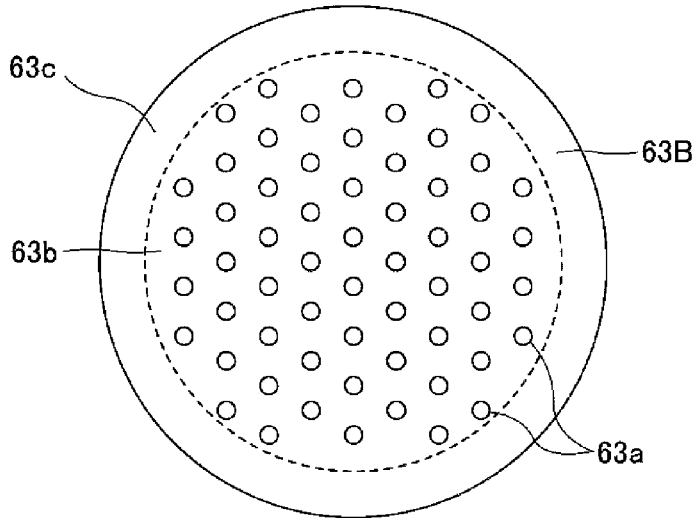
FIG. 8 is a plan view of the reinforcing member according to the embodiment, illustrating another configuration of the reinforcing member.

Alternatively, the reinforcing member 63 may be replaced with a reinforcing member 63B formed of punching metal as illustrated in FIG. 8. The reinforcing member 63B includes a center part 63*b* in which the holes 63*a* are formed and a peripheral edge part 63*c* in which no holes 63*a* are formed.

Figure 9:
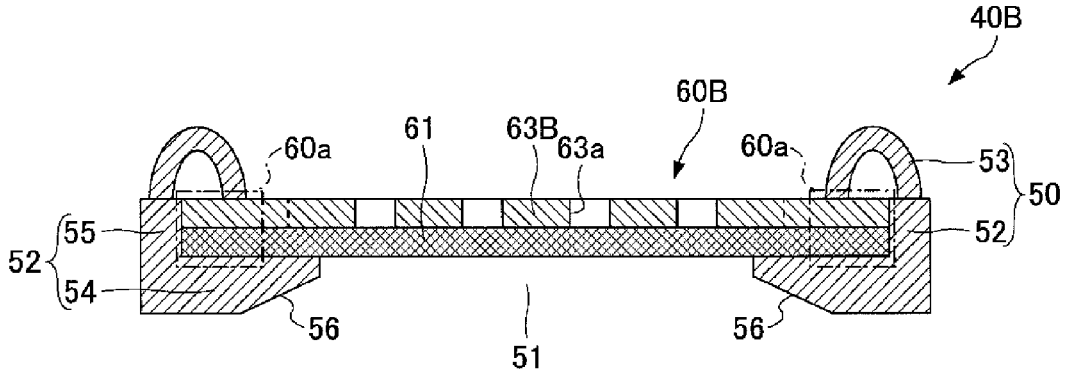
FIG. 9 is a schematic cross-sectional view of the partitioning member according to the embodiment, illustrating yet another configuration of the partitioning member.

FIG. 8 is a plan view of the reinforcing member 63B, illustrating a configuration of the reinforcing member 63B. In this case, the layered body 60 may have the two layers of the reinforcing member 63B and the filter member 61 stacked in this order from the claw part 53 side to the body part 52 side, that is, from the upper side to the lower side, of the layered body 60. FIG. 9 is a schematic cross-sectional view of a partitioning member 40B including a layered body 603 having such a structure, illustrating a configuration of the partitioning member 40B. In the case illustrated in FIG. 9 as well, it is possible to prevent formation of irregularities due to the holes 63*a* formed in the reinforcing member 63B on the surface (of the peripheral edge portion 60*a*) of the layered body 60B on its claw part 53 side. Thus, it is possible to prevent formation of a gap between the claw part 53 and the surface of the layered body 60B at the time of holding the peripheral edge portion 60*a* of the layered body 60B with the deformed claw part 53, thus preventing a regenerator material from moving beyond the partitioning member 40B through such a gap.

Further, as illustrated in FIG. 3 and FIG. 5, the body part 52 of the ring member 50 may include a tapered portion 56 around the opening 51. The tapered portion 56 is tapered so that the opening 51 increases in diameter in a direction from the claw part 53 side to the side opposite to the claw part 53 side with reference to the body part 52. This makes it possible to reduce pressure loss at a time when the refrigerant gas flows through the opening 51.

Figure 10:
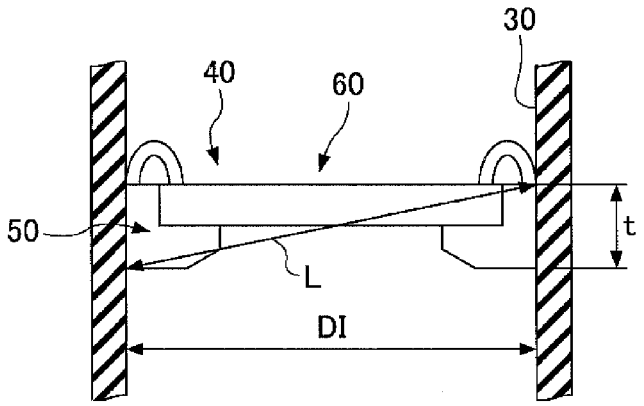
FIG. 10 is a diagram for illustrating a relationship between dimensions for preventing the partitioning member from rotating about an axis perpendicular to the central axis of a tube member according to this embodiment.

FIG. 10 is a diagram for illustrating a relationship between dimensions for preventing the partitioning member 40 from rotating about an axis perpendicular to the central axis of the tube member 30.

If the partitioning member 40 rotates about an axis perpendicular to the central axis of the tube member 30, the regenerator material may move beyond the partitioning member 40. Accordingly, a thickness t of the partitioning member 40 is so determined that a length L of a diagonal line of a cross section of the partitioning member 40 is sufficiently greater than an inside diameter DI of the tube member 30 as illustrated in FIG. 10. For example, the thickness t of the partitioning member 40 may be 15% or more of the inside diameter DI of the tube member 30.

The partitioning member 40 provided in the GM refrigerator according to this embodiment has such high dimensional accuracy as to prevent formation of a gap between the outer circumferential (peripheral) surface of the partitioning member 40 and the inner circumferential surface of the second-stage displacer 14 of the GM refrigerator, and makes it possible to reduce manufacturing cost. This is described below in comparison with a comparative example.

Figure 11:
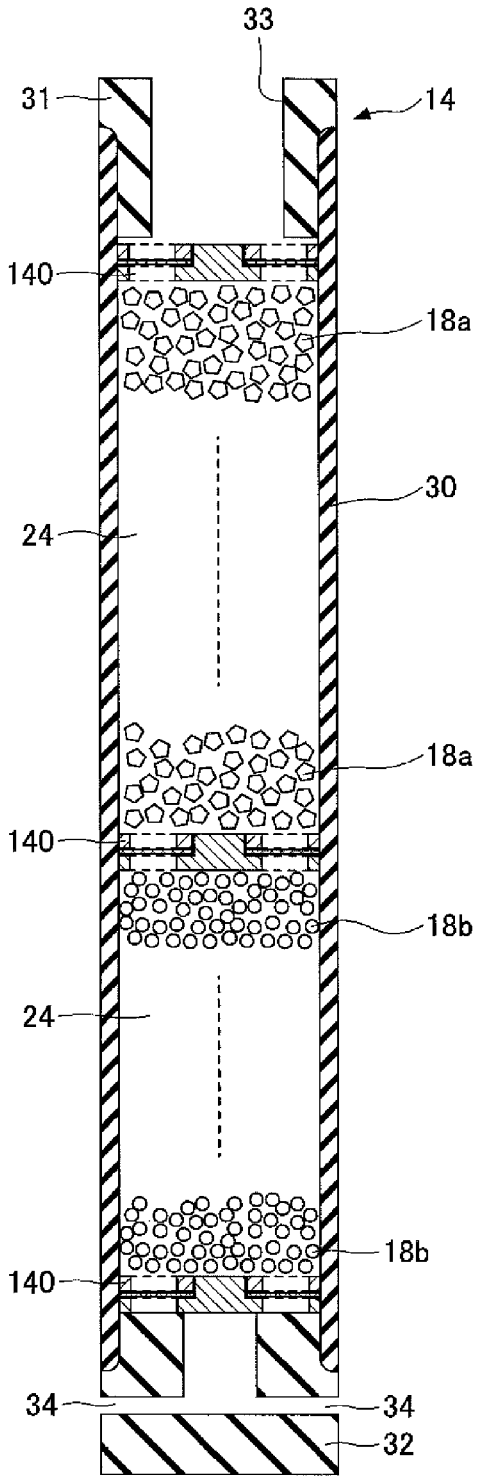
FIG. 11 is a schematic cross-sectional view of the second-stage displacer in a GM refrigerator according to a comparative example, illustrating a configuration of the second-stage displacer.
Figure 12:
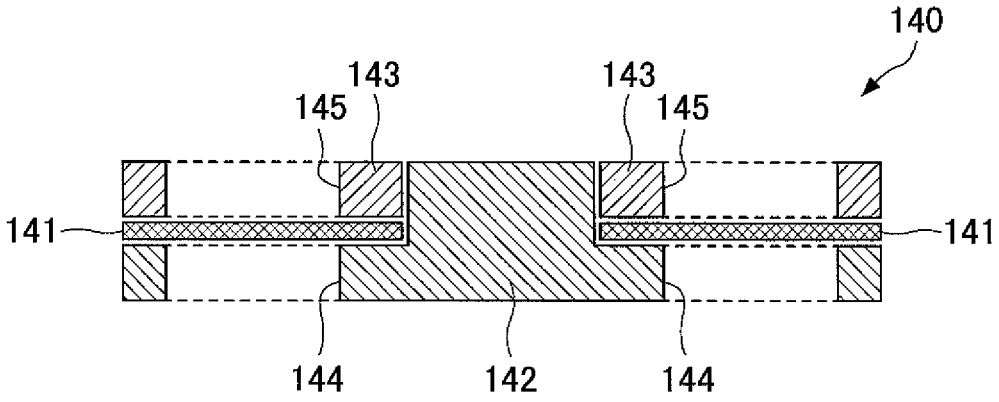
FIG. 12 is a schematic cross-sectional view of a partitioning member according to the comparative example, illustrating a configuration of the partitioning member.

FIG. 11 is a schematic cross-sectional view of the second-stage displacer 14 in a GM refrigerator according to the comparative example, illustrating its configuration. FIG. 12 is a schematic cross-sectional view of a partitioning member 140 according to the comparative example, illustrating its configuration.

The GM refrigerator according to the comparative example is different from the GM refrigerator according to this embodiment in that the second-stage displacer 14 includes the partitioning members 140 in place of the partitioning members 40*a*, 40*b*, and 40*c* of this embodiment.

Referring to FIG. 12, the partitioning member 140 includes a wire mesh 141 and metal plates 142 and 143.

The wire mesh 141 is a stack of layers of wire meshes that prevent passage of a regenerator material and allows passage of a refrigerant gas. The wire mesh 141 has a shape corresponding to the shapes of the metal plates 142 and 143, so that an opening is formed in the center of the wire mesh 141. The metal plates 142 and 143 are fixed by, for example, welding with the wire mesh 141 being held between the metal plates 142 and 143. Openings 144 and 145 are formed in the metal plates 142 and 143, respectively. Accordingly, the partitioning member 140 is so formed as to prevent passage of a regenerator material and allow passage of a refrigerant gas in a portion of the wire mesh 141 exposed in the openings 144 and 145.

If the outer circumferential (peripheral) surface of the partitioning member 140 does not have high dimensional accuracy, a gap may be formed between the outer circumferential surface of the partitioning member 140 and the inner circumferential surface of the second-stage displacer 14, so that movement of a regenerator material or mixture of regenerator materials may be caused through the formed gap. Accordingly, it is desirable to form the peripheral shape of the partitioning member 140 with good dimensional accuracy, in order to prevent formation of a gap between the outer circumferential surface of the partitioning member 140 and the inner circumferential surface of the second-stage displacer 14.

However, the partitioning member 140 according to the comparative example is formed by fixing the metal plates 142 and 143 by welding with the wire mesh 141 held between the metal plates 142 and 143. Therefore, the partitioning member 140 may not have a peripheral shape with good dimensional accuracy without improving the dimensional accuracy of the periphery of each of the metal plates 142 and 143 and the wire mesh 141. Further, the partitioning member 140 according to the comparative example includes the metal plates 142 and 143, and has a large number of components other than the wire mesh 141 having a filter function. In addition, it is necessary to fix the two metal plates 142 and 143 to each other with their centers being aligned with extremely high accuracy. Therefore, there may be the problem of an increase in manufacturing cost.

On the other hand, according to the partitioning member 40 (as well as the partitioning members 40A and 40B) of this embodiment, the peripheral edge portion 60*a* of the layered body 60 (as well as the layered bodies 60A and 60B) having a filter function is held tight from the upper side and the lower side by the ring member 50. It is possible to easily manufacture the partitioning member 40 with a good dimensional accuracy of its outer circumferential (peripheral) shape because there is no need to improve the dimensional accuracy of the peripheries of components other than the ring member 50. Further, according to the partitioning member 40 (as well as the partitioning members 40A and 40B) of this embodiment, the ring member 50 is provided as a unit. Therefore, for example, there is no need to fix two metal plates to each other with their centers being aligned with extremely high accuracy. Therefore, the partitioning member 40 (as well as the partitioning members 40A and 40B) of this embodiment has such high dimensional accuracy as to prevent formation of a gap between the outer circumferential (peripheral) surface of the partitioning member 40 and the inner circumferential surface of the second-stage displacer 14 of the GM refrigerator, and makes it possible to reduce manufacturing cost.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present inventions has been described in detail, it should be understood that various changes, substitutions, and alterations could be made hereto without departing from the spirit and scope of the invention.

For example, in the above-described embodiment, a description is given of the case where the partitioning member 40 (as well as the partitioning members 40A and 40B) is provided in the second-stage displacer 14. However, according to an aspect of the present invention, the partitioning member 40 may be provided in the first-stage displacer 13. In this case, the same effects as in the case of providing the partitioning member 40 in the second-stage displacer 14 are produced.

Further, in the above-described embodiment, a description is given of the case where a regenerative refrigerator including a partitioning member according to the present invention is applied to a GM refrigerator. However, according to an aspect of the invention, the partitioning member is not limited to a partitioning member that partitions off a regenerator material contained in the GM refrigerator, and may be applied to a partitioning member that partitions off a regenerator material contained in regenerators or regenerator tubes of various kinds of refrigerators, such as a regenerator material contained in a regenerator tube of a pulse tube refrigerator (corresponding to a regenerator [displacer] in embodiments of the present invention).

According to an aspect of the present invention, a partitioning member that partitions off a regenerator material contained in a regenerator of a regenerative refrigerator has such high dimensional accuracy as to prevent formation of a gap between the outer circumferential (peripheral) surface of the partitioning member and the inner circumferential surface of the regenerator, and makes it possible to reduce manufacturing cost.

What is claimed is:

1. A regenerative refrigerator, comprising:

a cylinder configured to cause a refrigerant gas to expand;

a regenerator containing a regenerator material and configured to accumulate, in the regenerator material, cold heat generated in the cylinder with expansion of the refrigerant gas; and a partitioning member provided in the regenerator and partitioning off the regenerator material, the partitioning member including a layered body including a filter member and a reinforcing member stacked in multiple layers, the filter member being configured to prevent passage of the regenerator material and to allow passage of the refrigerant gas, the reinforcing member being configured to reinforce the filter member; and a ring member including a body part that has a center opening formed therein and includes an outer circumferential surface fitting with an inner cylindrical surface of the regenerator; and a claw part provided on the body part on one side thereof in a stacking direction of the layered body, wherein the body part is a single unit including a placement part on which the layered body is placed to close the center opening; and a surrounding part that extends from the placement part and surrounds an outer circumferential surface of the layered body placed on the placement part without a peripheral edge portion of the layered body being exposed on an outer circumferential surface of the partitioning member, the surrounding part having an outer circumferential surface fitting with the inner cylindrical surface of the regenerator, wherein the claw part and the body part including the placement part form one single unit, and wherein the peripheral edge portion of the layered body is held tight from first and second opposite sides of the layered body in the stacking direction thereof by the claw part and the placement part.

2. The regenerative refrigerator as claimed in claim 1, wherein the filter member defines an outermost one of the layers of the layered body on the first side thereof in the stacking direction.

3. The regenerative refrigerator as claimed in claim 2, wherein the filter member further defines an outermost one of the layers of the layered body on the second side thereof in the stacking direction.

4. The regenerative refrigerator as claimed in claim 1, wherein the reinforcing member comprises a punching metal.

5. The regenerative refrigerator as claimed in claim 1, wherein the filter member comprises a wire mesh.

6. A partitioning member configured to partition off a regenerator material contained in a regenerator of a regenerative refrigerator, the partitioning member comprising:

a layered body including a filter member and a reinforcing member stacked in multiple layers, the filter member being configured to prevent passage of the regenerator material and to allow passage of a refrigerant gas, the reinforcing member being configured to reinforce the filter member; and a ring member including a body part that has a center opening formed therein and includes an outer circumferential surface so formed as to fit with an inner cylindrical surface of the regenerator; and a claw part provided on the body part on one side thereof in a stacking direction of the layered body, wherein the body part is a single unit including a placement part on which the layered body is placed to close the center opening; and a surrounding part that extends from the placement part and surrounds an outer circumferential surface of the layered body placed on the placement part without a peripheral edge portion of the layered body being exposed on an outer circumferential surface of the partitioning member, the surrounding part having an outer circumferential surface that fits with the inner cylindrical surface of the regenerator, wherein the claw part and the body part including the placement part form one single unit, and wherein the peripheral edge portion of the layered body is held tight from first and second opposite sides of the layered body in the stacking direction thereof by the claw part and the placement part.

7. The partitioning member as claimed in claim 6, wherein the filter member defines an outermost one of the layers of the layered body on the first side thereof in the stacking direction.

8. The partitioning member as claimed in claim 7, wherein the filter member further defines an outermost one of the layers of the layered body on the second side thereof in the stacking direction.

9. The partitioning member as claimed in claim 6, wherein the reinforcing member comprises a punching metal.

10. The partitioning member as claimed in claim 6, wherein the filter member comprises a wire mesh.

11. The regenerative refrigerator as claimed in claim 1, wherein the regenerator includes a tube member that contains the regenerator material, and wherein the tube member has a uniform thickness throughout a length thereof, and the outer circumferential surface of the surrounding part fits with an inner cylindrical surface of the tube member.

12. The partitioning member as claimed in claim 6, wherein the outer circumferential surface of the surrounding part fits with an inner cylindrical surface of a tube member of the regenerator, the tube member containing the regenerator material and having a uniform thickness throughout a length thereof.

* * * * *